US005915145A

United States Patent [19]

Shimura et al.

[11] Patent Number: 5,915,145

[45] Date of Patent: Jun. 22, 1999

[54] IMAGE FORMING APPARATUS

[75] Inventors: Masaru Shimura, Numazu; Hiroaki Sakai, Susono, both of Japan

[73] Assignee: Canon Kabushiki Kaisha, Tokyo, Japan

[21] Appl. No.: 08/898,046

[22] Filed: Jul. 18, 1997

[30] Foreign Application Priority Data

Jul. 19, 1996 [JP] Japan ..... 8-208906

[51] Int. Cl.[6] ..... G03G 15/16; G03G 15/20

[52] U.S. Cl. ..... 399/66; 399/314

[58] Field of Search ..... 399/66, 297, 310, 399/313, 314, 318

[56] References Cited

U.S. PATENT DOCUMENTS

| | | | |
|---|---|---|---|
| 5,034,777 | 7/1991 | Ohzeki et al. | 399/66 |
| 5,179,397 | 1/1993 | Ohzeki et al. . | |
| 5,303,014 | 4/1994 | Yu et al. | 399/314 |
| 5,339,144 | 8/1994 | Nakai et al. | 399/66 |
| 5,450,180 | 9/1995 | Ohzeki et al. . | |
| 5,530,522 | 6/1996 | Tsunemi | 399/66 |

*Primary Examiner*—Sandra Brase

*Attorney, Agent, or Firm*—Fitzpatrick, Cella, Harper & Scinto

[57] ABSTRACT

An image forming apparatus including an image bearing member, a transfer member cooperating with the image bearing member to form a nip therebetween for transferring an image from the image bearing member to a transfer material in the nip, and a control system for performing constant current control of the transfer member when the transfer material is not present in the nip and for performing constant voltage control of the transfer member with a voltage based on a voltage obtained while in constant current control, during image transferring to the transfer material. When the transfer material is not present in the nip, a predetermined voltage is applied to the transfer member and current flowing through the transfer member is detected, and, when a change in the current is decreased below a predetermined value, the constant current control is started.

14 Claims, 6 Drawing Sheets

CORONA TRANSFER TYPE

BIAS ROLLER TRANSFER TYPE

IMAGE FORMING APPARATUS

BACKGROUND OF THE INVENTION

1. Field of the Invention

The present invention relates to an image forming apparatus of a transfer type, i.e., an image forming apparatus for outputting an imaged copy by effecting an image forming process including the steps of forming a transferable image on an image bearing member such as a photo-conductive body (photosensitive body), a dielectric body, a magnetic body or an intermediate transfer body by an appropriate image forming means of an electrophotographic type, an electrostatic recording type or a magnetic recording type and transferring the transferable image formed on the image bearing member onto a transfer material such as a recording sheet by means of a transfer means. More particularly, the present invention relates to an image forming apparatus of an electrophotographic system of contact type in which the transfer material is introduced into and conveyed by a transfer nip defined between the image bearing member and a transfer member contacted with the image bearing member and transfer bias is applied to the transfer member to transfer the transferable image formed on the image bearing member onto the transfer material.

2. Related Background Art

In conventional image forming apparatuses of the transfer type, a transfer means for transferring a transferable image (referred to as "toner image" hereinafter) formed and borne on an image bearing member onto a transfer material such as a recording sheet, many systems such as a corona transfer system (noncontact electrostatic transfer type), a roller transfer system (bias roller transfer type, contact electrostatic transfer type) and the like have been used.

(a) Corona Transfer System

In the corona transfer system, as shown in FIG. 6, a corona charger 102 is opposed, in a noncontact relation, to an image bearing member 101 (for example, a rotating electrophotographic photosensitive drum), a transfer material P is introduced into a gap (transfer section) 103 between the image bearing member 101 and the corona charger 102, and a lower or under surface of the transfer material P (surface remote from the image bearing member 101) is exposed to corona shower discharged from the corona charger 102. By corona-charging the transfer material with a charging polarity opposite to that of the toner image t on the image bearing member 101, the toner image t on the image bearing member 101 is electrostatically transferred onto a front or upper surface of the transfer material P. Since the lower surface of the transfer material P is corona-charged by the corona charger 102 in the transfer section 103, the transfer material is closely contacted with the surface of the image bearing member 101 electrostatically. The transfer material P passed through the transfer section 103 is separated from the surface of the image bearing member 101 by a separation means (not shown), and the separated transfer material is conveyed to an image fixing means (not shown). The reference numeral 104 denotes a voltage applying electric power source; and 105 denotes a transfer material guide (pre-transfer guide).

In the corona transfer system, since the image is transferred onto the transfer material P in a condition that the image bearing member 101 is not contacted with the transfer means (corona charger) 102, damage of the image bearing member 101 can be minimized and various kinds of transfer materials can be used. However, since ozone and NOx are generated due to the corona discharge, there must be provided a means for removing the ozone and NOx. Further, since the corona charger 102 is used, the entire apparatus is made complicated and there is a danger of impinging the transfer material P against the corona charger 102.

(b) Roller Transfer System

In the roller transfer system, as shown in FIG. 7, a transfer roller (contact charge member) 106 having conductivity and elasticity is urged against an image bearing member 101 with a predetermined urging force to form a transfer nip (transfer section) N therebetween. The transfer roller 106 comprises a metallic core also acting as an electricity supply electrode, and a semiconductive rubber layer (base layer rubber) formed as a roller-shape around the metallic core, and is rotated in a rotational direction opposite to that of the image bearing member 101 at a peripheral speed substantially the same as that of the image bearing member 101.

The transfer material P is introduced into the transfer nip N and is pinched and conveyed by the transfer nip. While the transfer material P is being pinched and conveyed by the transfer nip N, a predetermined transfer bias is applied from a power source 107 to the metallic core of the transfer roller 106. As a result, a lower surface (remote from the image bearing member 101) of the transfer material P pinched and conveyed by the transfer nip N is contact-charged with a charging polarity opposite to that of the toner image t on the image bearing member 101 by the transfer roller 106 to which the transfer bias was applied, with the result that the toner image t on the image bearing member 101 is transferred onto the upper surface of the transfer material P. The transfer material P passed through the transfer nip N is separated from the surface of the image bearing member 101 by a separation means (not shown), and the separated transfer material is conveyed to an image fixing means (not shown).

In such a roller transfer system, since the voltage applied to the transfer roller (transfer member) 106 can be made smaller than the voltage in transferring devices utilizing the corona charger, generation of ozone and NOx can be suppressed. Further, since the image is transferred onto the transfer material P in the transfer nip N while the transfer material is being pinched between and conveyed by the image bearing member 101 and the transfer roller 106, the conveyance of the transfer material is stabilized. There is less danger of causing transfer deviation due to shock acting on the transfer material when the transfer material enters into and leaves from a transfer material convey means and a fixing means disposed at upstream and downstream sides of the transfer section. For these reasons, the roller transfer system has recently been used widely.

However, since a resistance value of the transfer roller (contact transfer member) 106 is varied with environmental conditions such as temperature and/or humidity and durability, a relation (V-I feature) between voltage applied to the transfer roller and current flowing through the transfer roller is greatly changed in accordance with the environmental conditions and the like. Thus, unless any countermeasure is provided, it is difficult to maintain good transferring ability under all of environmental conditions.

As one of transfer bias controlling systems for solving the above problems, an ATVC (Active Transfer Voltage Control) system has been proposed and used (for example, see U.S. Pat. No. 5,450,180). Such an ATVC system will now be briefly explained with reference to FIG. 8.

First of all, the transfer roller (transfer member) 106 is subjected to "constant current control" with current I1 before the transfer material P reaches the transfer nip (transfer section) N, and the voltage at that time is held.

When the transfer material P reaches the transfer nip N, "constant voltage control" is effected with the held voltage.

If the resistance of the transfer roller 106 is small under a high temperature/high humidity condition (H/H, 32.5° C., 85%), a relatively low voltage Va is applied to the transfer roller during the transferring; whereas, if the resistance of the transfer roller 106 is great under a low temperature/low humidity condition (L/L, 15° C., 10%), a relatively high voltage Vc is applied to the transfer roller during the transferring. Further, under a normal temperature/normal humidity condition (N/N, 23° C., 64%), a voltage Vb having an intermediate value between the values Va and Vc is applied to the transfer roller 106 during the transferring. In this way a, substantially desired transfer current can be obtained over the entire environmental conditions.

The improvement in the above ATVC control is disclosed in U.S. Pat. No. 5,179,397. In this control, the hold voltage obtained in the "constant current control" effected before the transfer material P reaches the transfer nip N (between the image bearing member and the transfer roller) is multiplied by a certain coefficient R to provide a control voltage, and, when the transfer material P reaches the transfer nip N, "constant voltage control" is effected with the control voltage. By appropriately selecting the coefficient R, a more proper transfer current can be obtained. That is to say, the bias applied to the transfer roller 106 has a voltage value determined in the so-called ATVC control system by calculation by using a pre-set control equation(s) on the basis of the voltage generated by applying a constant current (under "constant current control") to the transfer roller 106 from the power source 107 when the transfer material P is not present in the transfer nip N.

By performing such control, regarding the bias applied to the transfer roller 106 during the transferring of the toner image onto the transfer material P, even if the resistance of the transfer roller 106 is varied with the temperature and/or humidity, the bias optimum to the changed resistance can be applied to the transfer roller, thereby obtaining a good transferred image.

However, when a transfer member having electrostatic capacity is used as a transfer roller, in the above conventional ATVC control systems and roller transfer systems, since the electrostatic capacity of the transfer roller (transfer member) is not taken in consideration, the constant current control for determining the transfer bias voltage for the transfer member is performed during transient response. Thus, when the so determined constant voltage value (transfer voltage) is used, the current is gradually decreased by the transient phenomenon, so that saturation is reached at a current value smaller than the current value which is actually required. In this case, under a low temperature/low humidity condition in which the resistance of the transfer material becomes great or in a condition that a second surface of the transfer material is copied in a both-face copy mode, an amount of charges applied from the transfer roller to the transfer material becomes insufficient due to poor transfer current, so that it is difficult to correctly transfer the toner image formed on the image bearing member onto the transfer material and to hold the toner image transferred to the transfer material on the transfer material, to thereby cause the poor image.

In this case, in a transfer roller not having an outermost coating layer as is in the prior art, since a thickness of the base rubber layer is generally is great (several millimeters), the electrostatic capacity thereof becomes small to reduce the transient response time. However, for example, in a case where the transfer roller has one or more outer coating layer(s), when the electrostatic capacity thereof is great in comparison with the transfer roller not having any coating layer, the transient response time becomes longer, and, when volume resistance of the coating layer is greater than that of the base rubber layer, the reduction amount of the current becomes particularly great. Thus, the transfer current differs from each other between the case where the transfer bias is determined by the constant current control and the case where the determined voltage is applied to the transfer roller during the image transferring, to thereby cause the insufficient transfer current due to the transient phenomenon. As a result, there is a greater danger of generating a poor image in comparison with the transfer roller having no coating layer.

Explaining in more detail, in the transfer roller having the coating layer, the transfer bias is determined by control as shown in FIG. 9. That is to say, the transfer bias has a voltage value determined in the so-called ATVC control system by calculation by using a pre-set control equation(s) on the basis of the voltage generated by applying a constant current (under "constant current control") to the transfer roller 106 from the power source 107 for a time period T1 when the transfer material is not present in the transfer nip N. By performing such control, regarding the bias applied to the transfer roller 106, even if the resistance of the transfer roller 106 is varied with the temperature and/or humidity, the bias optimum to the changed resistance can be applied to the transfer roller, to thereby realize a good transferred image.

However, in general, when the constant voltage continues to be applied to the transfer roller 106, the transient phenomenon as shown in FIG. 10 occurs. This phenomenon noticeably occurs in the transfer roller having one or more coating layer(s) and can be explained by using an equivalent circuit as shown in FIG. 11. In FIG. 11, R1 denotes a resistance value of the base rubber layer 15*b* of a transfer roller 15, R2 denotes a resistance value of a coating layer 15*c* and C denotes electrostatic capacity of the coating layer 15*c* . In such a circuit, when voltage V is applied, current I flowing through the circuit can be represented as follows:

$$I = \frac{V}{R_1 + R_2}\left\{1 + \frac{R_2}{R_1}\exp\left(-\frac{R_1 + R_2}{R_1 R_2 C}\right)\right\} \quad (1)$$

Here, in FIG. 10, the current is gradually decreased from a current value Ia (at a time Ta when the constant voltage bias is started) to a current value Ib. According to the above equation (1), when a time at which the current value reaches Ib is Tb, (Tb−Ta) depends upon the resistance and electrostatic capacity of the transfer roller and (Ia−Ib) depends upon the resistance value of the transfer roller. It can be seen that, in the transfer roller having small resistance, the values of (Ia−Ib) and (Tb−Ta) become small, and, in the transfer roller having small electrostatic capacity, the value of (Tb−Ta) becomes small.

For example, when a time period between the time at which the constant voltage bias to the transfer roller is started to the time at which the image transferring is started is short, in some cases, the current is decreased due to the transient phenomenon to cause poor current transfer.

Further, as previously described in connection with FIG. 9, even when the constant current control is effected for the transfer roller to determine the transfer voltage, in some cases, the transient phenomenon occurs. That is to say, as shown in FIG. 5, the voltage is increased from a voltage value Va applied to the transfer roller at the time (Ta) when the constant current control of the transfer roller is started to a voltage value Vb applied to the transfer roller at the time (Tb) when the transient phenomenon is substantially finished. A value of such (Tb−Ta) also depends upon the resistance and electrostatic capacity of the transfer roller. If the voltage applied to the transfer roller is detected on the way of the transient phenomenon, (since lower voltage is detected) it is judged that the resistance of the transfer roller is low in comparison with the actual resistance of the transfer roller, with the result that the poor current transfer occurs in the transferring.

As mentioned above, it is considered that, as the transient phenomenon, there arises a phenomenon in which the current flowing through the transfer roller is gradually decreased from the time when the constant voltage is applied to the transfer roller and a phenomenon in which the voltage applied to the transfer roller is gradually decreased from the time when the constant current is applied to the transfer roller. In this way, in the transfer roller having at least one coating layer, the resistance thereof differs from each other between a case where the control (such as ATVC control) for determining the transfer bias under the transient phenomenon and a case where the determined voltage is applied to the transfer roller. As a result, the transfer current is also differentiated, to thereby cause insufficient transfer current, and, a poor image.

It is considered that the voltage or the current continues to be always applied to the transfer roller for a predetermined time period in consideration of the transient phenomenon before the image transferring and before the ATVC control. However, since the resistance and the electrostatic capacity of the transfer roller is varied with a change in the environmental condition such as temperature and/or humidity, the time when the transient phenomenon is finished is changed in accordance with the environmental condition. Further, when the above-mentioned predetermined time period is selected too long, productivity of image formation is worsened.

SUMMARY OF THE INVENTION

An object of the present invention is to provide an image forming apparatus which can solve the above-mentioned problem that control accuracy for a transfer member is worsened due to a transient phenomenon.

Another object of the present invention is to provide an image forming apparatus in which a transfer member which may cause a transient phenomenon can easily be handled and which can widen an available latitude for such a transfer member.

A further object of the present invention is to provide an image forming apparatus which can prevent reduction of productivity of image formation regardless of change in environmental conditions.

The other objects and features of the present invention will be apparent from a detailed explanation of the invention referring to the accompanying drawings.

DETAILED DESCRIPTION OF THE PREFERRED EMBODIMENTS

First Embodiment FIGS. 1 to 4

(1) Image Forming Apparatus

Figure 1:
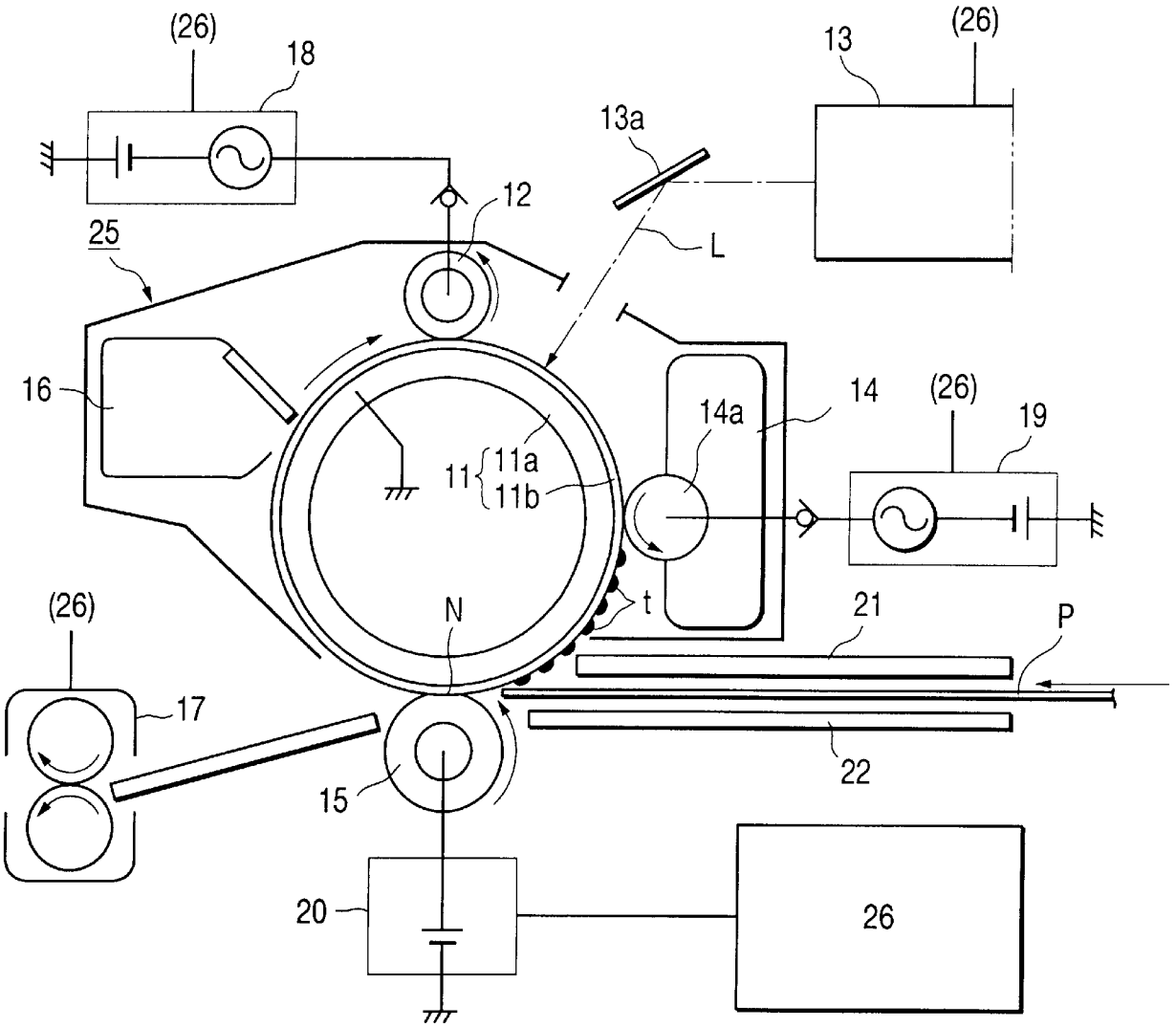
FIG. 1 is a schematic sectional view of an image forming apparatus according to the present invention.

FIG. 1 is a schematic view showing a laser beam printer (LBP) of roller transfer type performing an electrophotographic process as an example of an image forming apparatus.

A rotating drum-shaped electrophotographic photosensitive member (referred to as "photosensitive drum" hereinafter) 11 acting as an image bearing member is constituted by a conductive drum base 11*a* and a photosensitive layer 11*b* provided on an outer peripheral surface of the drum base. The photosensitive drum 11 is rotated in a clockwise direction (shown by the arrow) at a predetermined speed (process speed).

In the illustrated embodiment, a charge means 12 for charging the photosensitive drum 11 comprises a charge roller (conductive elastic roller) contacted with the photosensitive drum 11 with a predetermined force, and the charge roller is rotatingly driven by the rotation of the photosensitive drum 11. A predetermined alternate current (overlapped with predetermined voltage) is applied to the charge roller 12 from a charge bias apply power source 18, so that an outer peripheral surface of the photosensitive drum 11 is uniformly charged to predetermined polarity and potential in a contact charging manner.

Laser light modulated in correspondence to an electric digital signal of image information is outputted from a laser scanner (image information exposure means) 13, and the charged surface of the rotating photosensitive drum 11 is scanned by the exposure light (laser light) L, so that an electrostatic latent image corresponding to the image information is formed on the surface of the photosensitive drum 11. The laser light emitted from the laser scanner 13 is deflected toward a desired position on the photosensitive drum 11 by a mirror 13*a*.

A developing device 14 serves to visualize the electrostatic latent image formed on the rotating photosensitive drum with toner as a toner image (transferable image) in inverse development or normal development. A development bias apply power source 19 serves to apply development bias to a developing member (for example, developing roller, developing sleeve and the like) 14*a* of the developing device 14.

A rotatable transfer roller 15 is urged against the photosensitive drum 11 with a predetermined force to form a transfer nip N therebetween and is rotated in a direction opposite to the rotational direction of the photosensitive drum 11 at a peripheral speed substantially the same as that of the photosensitive drum. A transfer bias apply power source 20 serves to apply transfer bias to the transfer roller 15. A structure of the transfer roller 15 and transfer bias control will be described later.

A transfer material (such as a sheet) P is supplied from a sheet supply mechanism portion (not shown) in response to a sheet supply signal, and the supplied transfer material is passed between upper and lower convey guides (pre-transfer guides) 21 and 22 and is introduced into the transfer nip N (between the photosensitive drum 11 and the transfer roller 15 urged against the photosensitive drum) at a predetermined timing (i.e., at a timing that a tip end of the transfer material P just reaches the transfer nip N when a tip end of the toner image formed on the photosensitive drum 11 reaches the transfer nip N to achieve the registration between the toner image and the transfer material).

The transfer material P introduced into the transfer nip N is conveyed while it is pinched between the photosensitive drum 11 and the transfer roller 15. Meanwhile, predetermined transfer bias is applied to the transfer roller 15 from the power source 20. As a result, a lower surface (under surface) of the transfer material P being conveyed through the transfer nip N is contact-charged with charging polarity opposite to that of the toner image t formed on the photosensitive drum 11 by the transfer roller 15 to which the transfer bias was applied, so that the toner image t formed on the photosensitive drum 11 is electrostatically transferred onto a front surface of the transfer material P.

The transfer material P which was passed through the transfer nip N and to which the toner image was transferred is separated from the surface of the photosensitive drum 11 by a separation means (not shown), and the separated transfer material is introduced into a fixing device 17, where the toner image is permanently fixed to the transfer material with heat and pressure from the fixing device 17. On the other hand, after the transfer material is separated from the photosensitive drum, residual toner and foreign matters remaining on the photosensitive drum 11 are removed by a cleaner 16, to thereby prepare for next image formation.

In a both-face print mode and a multi-print mode, the transfer material (the image was formed on a first surface thereof or a first image was formed on the transfer material) is introduced into a recirculating sheet path mechanism (not shown), where the transfer material is turned over or not turned over. Then, the transfer material is introduced into the transfer nip N again, where an image is formed on a second surface of the transfer material or a second image is formed on the same first surface of the transfer material. Then, the transfer material is again introduced into the fixing device 17.

The illustrated printer can utilize a process cartridge 25 integrally incorporating the photosensitive drum 11, charge roller 12, developing device 14 and cleaner 16 therein as four process means and removably mounted on the printer. Incidentally, a combination of the process means incorporated into the process cartridge is not limited to the above described combination.

A control circuit 26 of the printer serves to perform sequence-control of the printer mechanism and to control the charge bias apply power source 18, development bias apply power source 19 and transfer bias apply power source 20 to properly control the respective biases.

(2) Transfer Roller and Transfer Bias Control a) Structure of Transfer Roller 15

Figure 2:
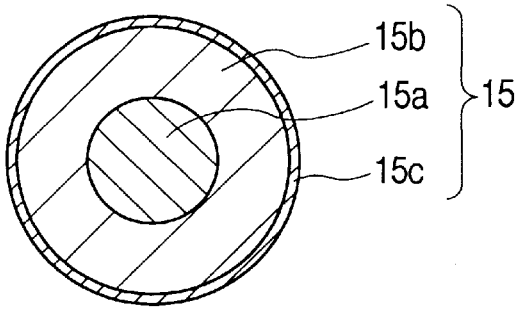
FIG. 2 is a sectional view of a transfer roller of the image forming apparatus.

As shown in FIG. 2, the transfer roller 15 in the illustrated embodiment comprises a conductive shaft 15*a* also acting as an electricity supply electrode, a conductive elastic layer (base rubber layer) 15*b* and a coating layer 15*c*. The transfer bias is applied to the conductive shaft 15*a* from the transfer bias apply power source 20.

The conductive shaft 15*a* of the transfer roller 15 is formed from a nickel-plated copper rod having a diameter of 8 mm, the elastic layer 15*b* is formed from carbon-dispersed foam EPDM having a thickness of 5 mm and the coating layer 15*c* is formed from urethane rubber (in which conductive powder is not dispersed) having a thickness of 0.1 mm. The elastic layer 15*b* may be obtained by foaming and vulcanizing EPDM (ethylene propylene rubber), urethane rubber, hydrine rubber, silicone rubber or NBR (nitrile butadiene rubber). Although the coating layer 15*c* may be omitted, it is preferably provided in consideration of contamination of the drum and high durability of the drum. At least one coating layer may be provided, and each coating layer is made of EPDM, urethane rubber, hydrine rubber, silicone rubber or NBR and conductive powder such as carbon or titanium oxide in order to adjust the resistance value.

b) Transfer Bias Control

The control circuit portion 26 serves to control the output of the transfer bias apply power source 20 so that the properly constant-voltage-controlled transfer bias can be applied to the transfer roller 15 while the transfer material is being conveyed in the transfer nip N, i.e., during the transferring. That is to say, the control circuit portion 26 starts to apply a predetermined constant voltage to the transfer roller 15 from the transfer bias apply power source 20 when the transfer material P is not present in the transfer nip N and causes the power source 20 to output the transfer bias having pre-selected transfer bias value to perform the constant voltage control of the transfer roller 15 when the transfer material P is present in the transfer nip N after the transient phenomenon is finished at the predetermined current value.

Figure 3:
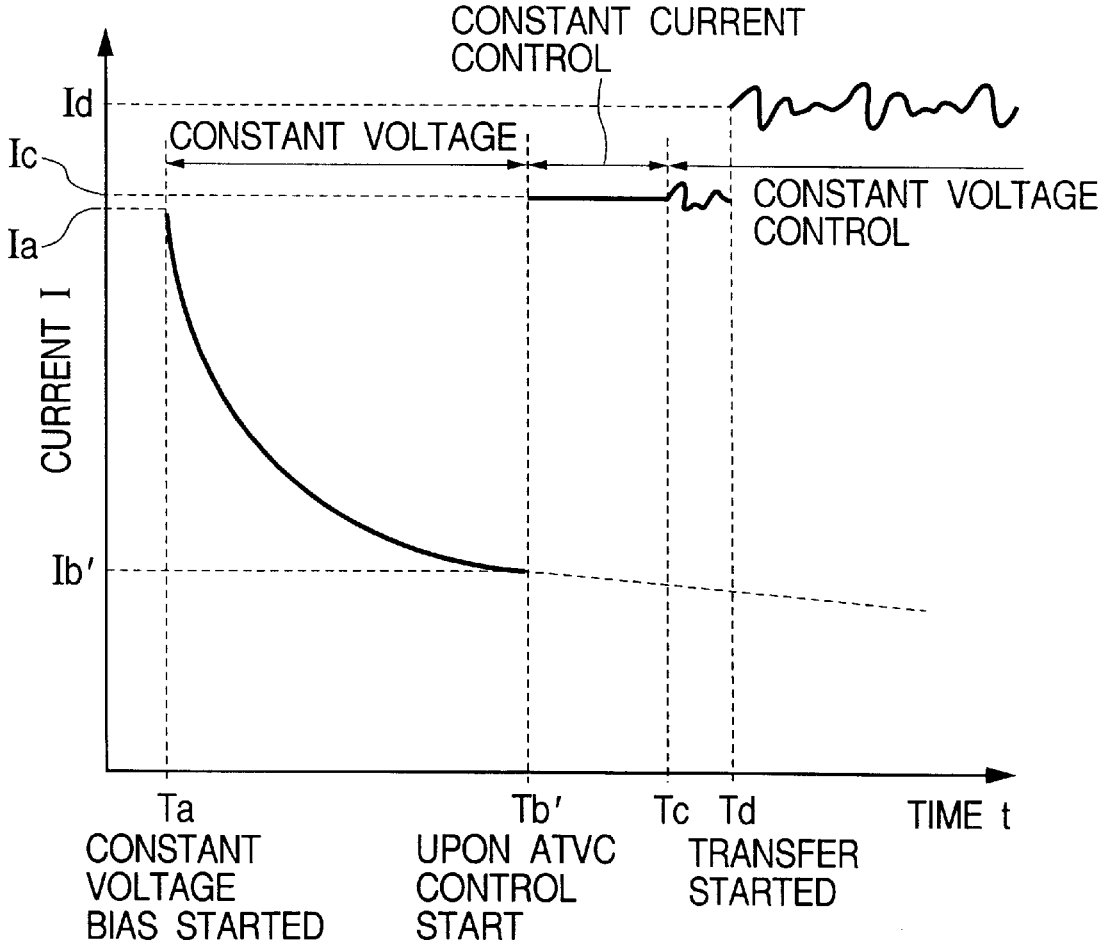
FIGS. 3 and 4 are graphs for explaining transfer bias control according to a first embodiment.

In the illustrated embodiment, as shown in FIG. 3, in the case where the transfer material P is not present in the transfer nip N, when it is assumed that a time when the current reaches a set current value Ib' (from a stable point) is Tb', the constant voltage is applied to the transfer roller between Ta and Tb'. Then, the constant current control of the transfer roller 15 with current Ic to determine the transfer bias from the time Tb' (at this point, the current is stabilized) to a time Tc in FIG. 3. Thereafter, at a time Td when the transfer material P enters into the transfer nip N, by applying the transfer bias determined from the control equation to the transfer roller, the poor transfer current (which may be caused by a false resistance change due to the transient phenomenon) is prevented, to thereby permit the transfer bias control with the actual target current value Id as shown in FIG. 3.

Specifically, in the illustrated embodiment, the printer is an LBP of cartridge type capable of obtaining 24 copies per minute. In this printer, the constant voltage is applied upon the transient response of the transfer roller 15, the current value so applied is sampled every predetermined time period, the change in current value is measured, the ATVC control (constant current control) is started when the change in current value is decreased below a predetermined threshold (at this time, it is considered that the transient phenomenon is finished), and the transfer bias is determined on the basis of the voltage applied to the transfer roller during the constant current control. For example, the transfer bias may be selected as a value obtained by multiplying the voltage applied to the transfer roller during the constant current control by a coefficient (>1).

Figure 4:
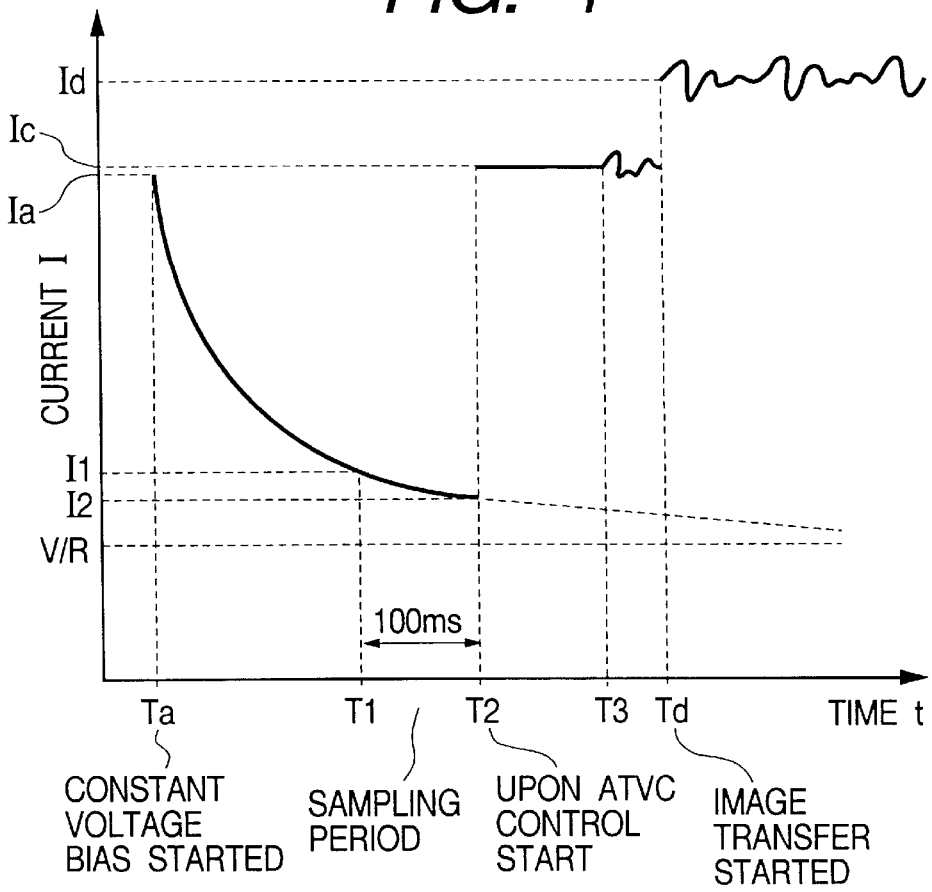
Figure 5:
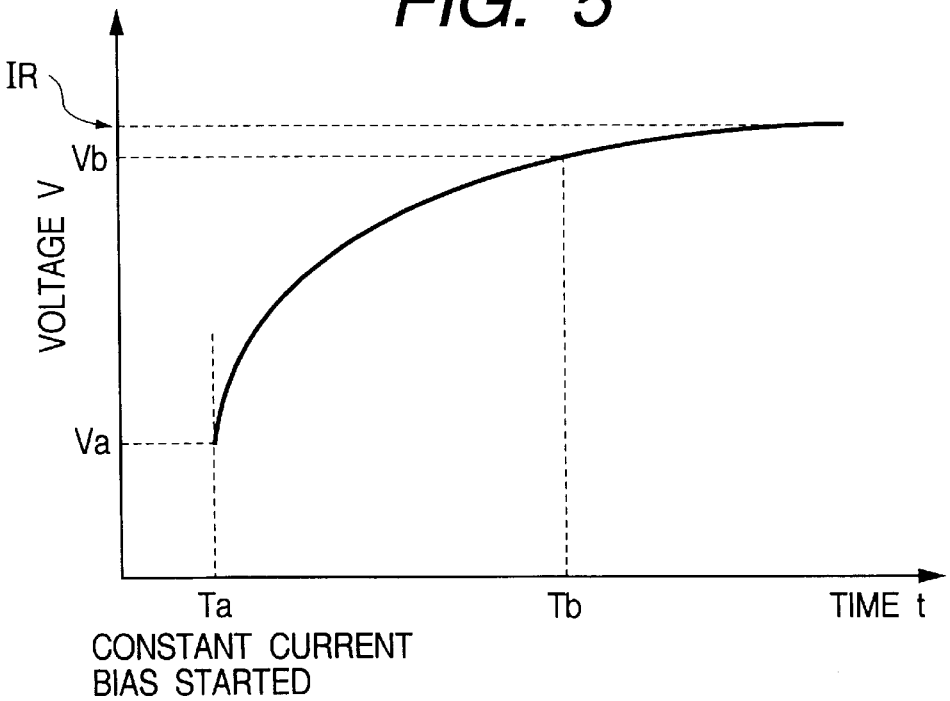
FIG. 5 is a graph for explaining a transient response phenomenon.
Figure 6:
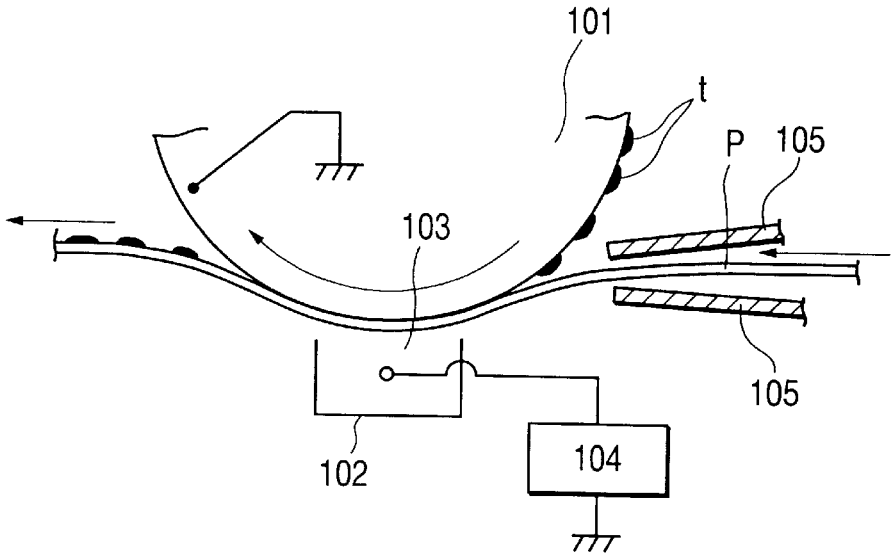
FIG. 6 is an enlarged partial view for explaining a corona transfer system.
Figure 7:
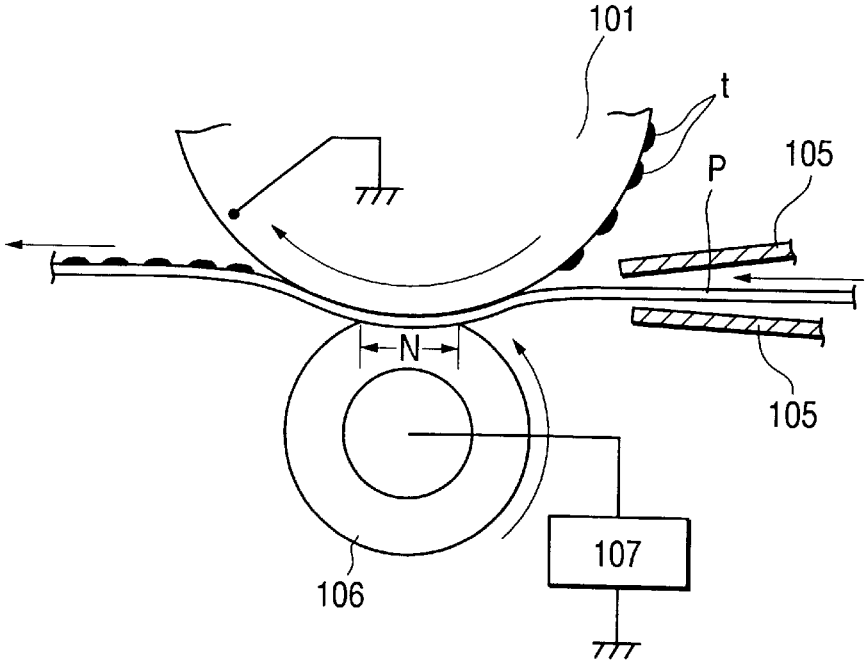
FIG. 7 is an enlarged partial view for explaining a bias roller transfer system.
Figure 8:
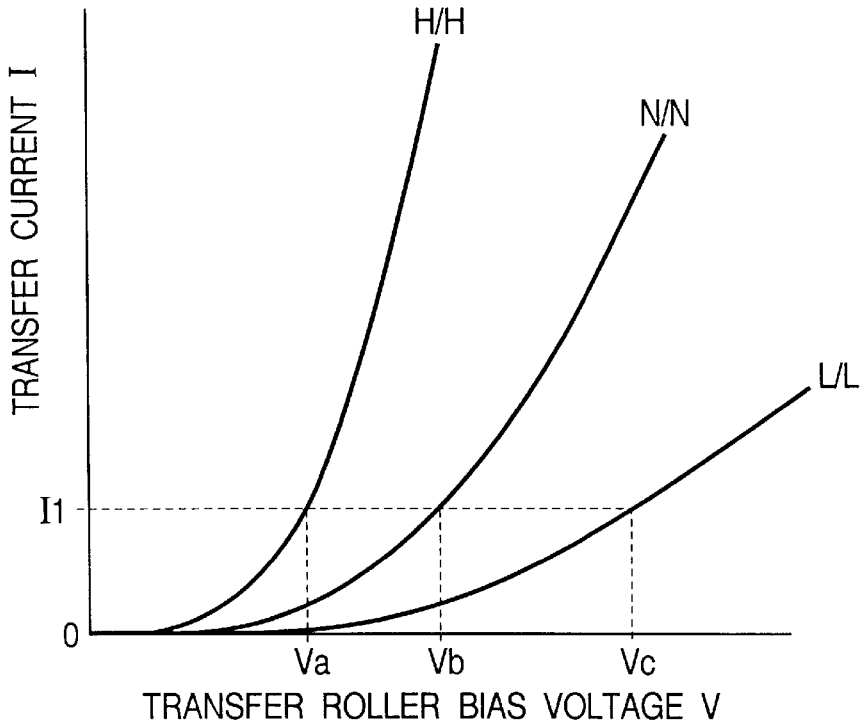
FIG. 8 is a graph showing change in a V-I feature under a condition of a transfer roller.
Figure 9:
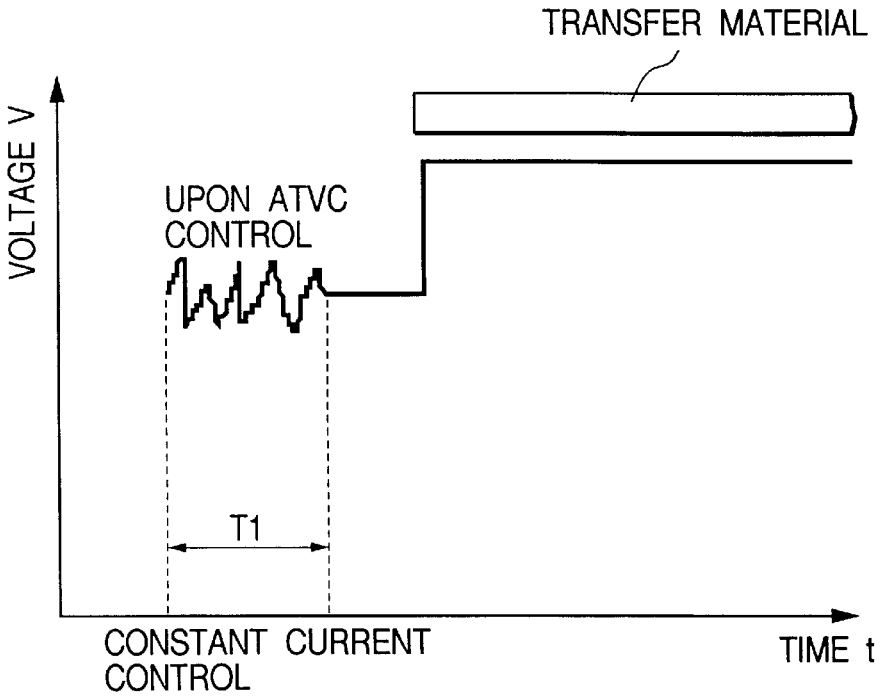
FIG. 9 is a graph for explaining general control for determining transfer bias.
Figure 10:
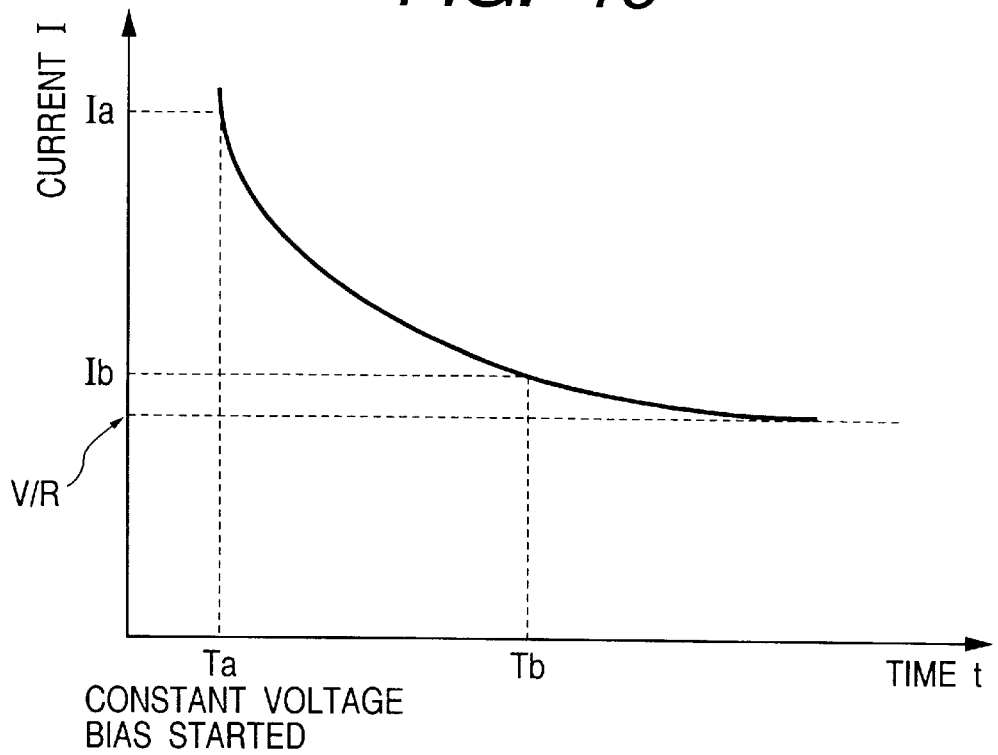
FIG. 10 is a graph for explaining a transient response phenomenon.
Figure 11:
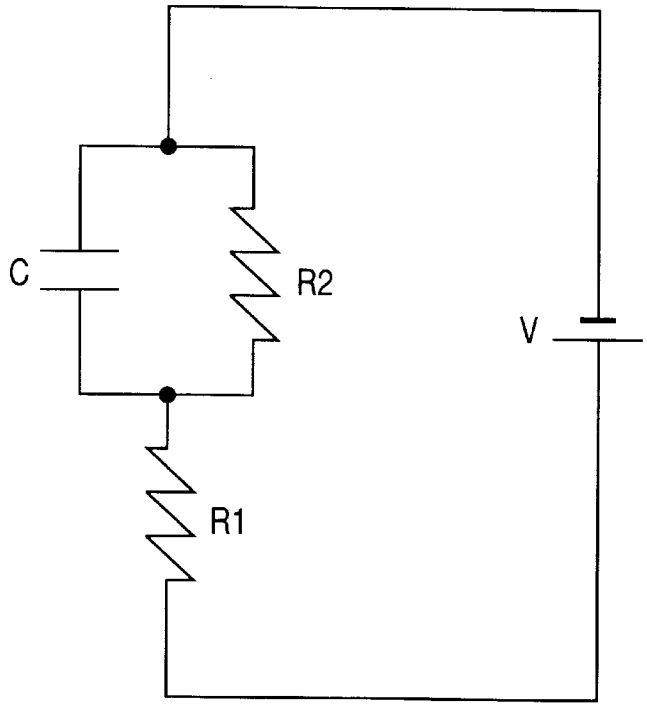
FIG. 11 is an explanatory view for explaining an equivalent circuit for the transfer roller.

Specifically, as shown in FIG. 4, when the constant voltage V is applied to the transfer roller having resistance R, since the current value is gradually decreased, in the illustrated embodiment, a sampling period (T2−T1) is selected to 100 ms, and, when it is assumed that the current value at T1 is I1 and the current value at T2 is I2, as a value (I2–I1) is decreased below V/(100×R), the ATVC control is performed between T2 and T3, and the transfer bias calculated from the control equation is applied to the transfer roller at the time Td when the transfer material enters into the transfer nip N.

Actually, since the above condition (that the transient phenomenon is finished) is satisfied by applying the constant voltage of 0 kV for about 5 seconds, the ATVC control is performed thereafter. The poor transfer current which may be caused by a false resistance change due to the transient phenomenon is prevented, to thereby permit the transfer bias control with the actual target current value Id. Incidentally, the sampling period and the change in current value by which the constant current control is started can be appropriately changed in accordance with a voltage/current feature of the transfer roller and the process speed of the photosensitive drum. Further, the finish time of the transient phenomenon (sampling period) is changed in accordance with the resistance and capacity of the transfer roller.

In this way, the poor transferred image which may be caused by insufficient charge amount applied from the transfer roller 15 to the transfer material due to insufficient transfer current in the low temperature/low humidity condition (in which the resistance of the transfer material P is increased) or in the image formation for the second surface of the transfer material in the both-face print mode, and, the poor image which may be caused due to difficulty for holding the toner image on the transfer material can be prevented, thereby correctly transferring the transferable image (toner image) formed on the photosensitive drum 11 onto the transfer material P. Further, the handling of the transfer roller 15 having one or more coating layers can be facilitated.

Other Embodiments (1) In the above-mentioned embodiment, while an example that the constant current control (as ATVC control) of the transfer roller is performed to determine the transfer voltage to be applied to the transfer roller was explained, in place of this example, the constant voltage control of the transfer roller for determining the transfer voltage may be performed to detect the current flowing through the transfer roller. That is to say, the transfer voltage may be determined on the basis of the current flowing through the transfer roller. Preferably, the voltage during the constant voltage control for determining the transfer voltage is gradually increased from 0 V step by step every predetermined interval, for example, by PWM control so that excessive current is not supplied to the photosensitive drum from the transfer roller, and, when the predetermined current is reached, the increase of the voltage is stopped. The voltage during the constant voltage control for determining the transfer voltage may be smaller than the transfer voltage subjected to the constant voltage control during the image transferring to protect a transfer memory and be greater than the constant voltage upon the transient phenomenon. When conductive particles, such as carbon particles, are included in the transfer roller, since the resistance of the transfer roller particularly depends upon the voltage, the voltage during the constant voltage control for determining the transfer voltage is preferably near the transfer voltage.

Similarly, in FIG. 3, the voltage applied to the transfer roller during the constant current control is preferably greater than the constant voltage upon the transient phenomenon and is preferably smaller than the transfer voltage to protect the transfer memory.

(2) A time period during which the transfer material is not present in the transfer nip N in the constant current control or the constant voltage control for determining the transfer voltage is a time period (so-called "sheet-to-sheet interval") from when the image transferring regarding a preceding transfer material is effected to when the image transferring regarding a succeeding transfer material is effected, and a time period (so-called "pre-multirotation process") from when a warming-up operation of the apparatus is started after power ON to when a stand-by condition of the apparatus is established. A time period (so-called "pre-rotation process") from when the stand-by condition is driven by a print start signal to when the actual print operation is started, and a time period (so-called "post-rotation process") from when the print operation for a desired number of copies is finished to when the stand-by condition is restored.

(3) The transfer member is not limited to the roller member (transfer roller) in the illustrated embodiment, but may comprise a rotating belt or a blade. Further, the transfer member may have no surface coating layer.

(4) The image bearing member of the image forming apparatus, and principle and process for forming the transferable image on the image bearing member are not limited to the photosensitive drum and the electrophotographic process as illustrated in the above embodiment. The image forming apparatus may include an intermediate transfer member as an image bearing member in which a plurality of toner images are successively superimposed to form a color image or a multi image on the intermediate transfer member and the transferred toner images are collectively transferred onto a transfer material by a contact electrostatic transfer system.

While a transfer roller having the coating layer was explained as a transfer roller generating noticeable transient phenomenon, a transfer roller having a base core and a single elastic layer may be similarly used so long as surface treatment is effected on the transfer roller. For example, (i) bridging ability of the surface of the roller may be increased by applying heat, (ii) bridging molecular structure of the roller surface may be changed by utilizing energy of UV (ultraviolet rays), (iii) polar group may be removed from the roller surface by using coupling agent capable of coupling to the polar group, (iv) the roller surface may be subjected to plasma treatment (same effect as UV), or (v) the roller surface may be subjected to ion beam treatment (same effect as UV). As mentioned above, regarding transfer rollers subjected to the surface treatment, the ATVC control may be started after the transient phenomenon is finished.

What is claimed is:

1. An image forming apparatus comprising:

an image bearing member;

a transfer member cooperating with said image bearing member to form a nip therebetween for transferring an image from said image bearing member to a transfer material in said nip; and a control means for performing constant current control of said transfer member when the transfer material is not present in the nip, and for performing constant voltage control of said transfer member with a voltage based on a voltage obtained while in constant current control, during image transferring to the transfer material;

wherein when the transfer material is not present in the nip, a predetermined voltage is applied to said transfer member to detect current flowing through said transfer member to thereby start the constant current control when a change in the current is decreased below a predetermined value, the change in accordance with a change of resistance of said transfer member.

2. An image forming apparatus according to claim 1, wherein said transfer member includes an electrode, an elastic layer supported by said electrode, and a coating layer provided on an outer surface of said transfer member.

3. An image forming apparatus according to claim 1, wherein said transfer member is subjected to surface-treatment.

4. An image forming apparatus according to claim 1, wherein the predetermined voltage is smaller than the voltage obtained during constant current control.

5. An image forming apparatus according to claim 1 or 4, wherein the voltage obtained during constant current control is smaller than the voltage applied to said transfer member during constant voltage control.

6. An image forming apparatus according to claim 1, wherein electric power continues to be supplied to said transfer member during a time period from when the constant current control is started to when the image transferring is started.

7. An image forming apparatus according to claim 1, wherein said transfer member has a roller shape.

8. An image forming apparatus comprising:

an image bearing member;

a transfer member cooperating with said image bearing member to form a nip therebetween for transferring an image from said image bearing member to a transfer material in the nip; and a control means for performing first constant voltage control of said transfer member when the transfer material is not present in the nip, and for performing second constant voltage control of said transfer member with a voltage based on current flowing through said transfer member during the first constant voltage control, during image transferring to the transfer material;

wherein when the transfer material is not present in the nip a predetermined voltage is applied to said transfer member and current flowing through said transfer member is detected to thereby start the first constant voltage control when a change in the current is decreased below a predetermined value, the change in accordance with change of resistance of said transfer member.

9. An image forming apparatus according to claim 8, wherein said transfer member includes an electrode, an elastic layer supported by said electrode, and a coating layer provided on an outer surface of said transfer member.

10. An image forming apparatus according to claim 8, wherein said transfer member is subjected to surface-treatment.

11. An image forming apparatus according to claim 8, wherein the predetermined voltage is smaller than the voltage applied to said transfer member during first constant voltage control.

12. An image forming apparatus according to claim 8 or 11, wherein the voltage applied to said transfer member during first constant voltage control is smaller than the voltage applied to said transfer member during second constant voltage control.

13. An image forming apparatus according to claim 8, wherein electric power continues to be supplied to said transfer member during a time period from when the first constant voltage control is started to when the image transferring is started.

14. An image forming apparatus according to claim 8, wherein said transfer member has a roller shape.

* * * * *

UNITED STATES PATENT AND TRADEMARK OFFICE

CERTIFICATE OF CORRECTION

PATENT NO. : 5,915,145

DATED : June 22, 1999

INVENTOR(S) : MASARU SHIMURA ET AL.

It is certified that error appears in the above-identified patent and that said Letters Patent is hereby corrected as shown below:

COLUMN 3:

Line 15, "way a," should read --way, a--; and
Line 64, delete "is" (second occurrence).

COLUMN 7:

Line 50, "above" should read --above- --.

Signed and Sealed this

Fifteenth Day of February, 2000

*Attest:*

*Attesting Officer*

Q. TODD DICKINSON

*Commissioner of Patents and Trademarks*